US007557315B2

(12) United States Patent
Chen

(10) Patent No.: US 7,557,315 B2
(45) Date of Patent: Jul. 7, 2009

(54) LIMIT SWITCH WITH TWO OPERATION UNITS CONTROLLED BY A SINGLE CONTROL MEMBER

(75) Inventor: Ming-Min Chen, Pitou Township, Changhua County (TW)

(73) Assignee: J-Star Motor Industrial Co., Ltd., Taipei (TW)

( * ) Notice: Subject to any disclaimer, the term of this patent is extended or adjusted under 35 U.S.C. 154(b) by 458 days.

(21) Appl. No.: 11/360,443

(22) Filed: Feb. 24, 2006

(65) Prior Publication Data

US 2007/0199808 A1 Aug. 30, 2007

(51) Int. Cl.
*H01H 3/16* (2006.01)
*H01H 3/18* (2006.01)
*H01H 15/14* (2006.01)

(52) U.S. Cl. ..... 200/47

(58) Field of Classification Search ..... 200/47
See application file for complete search history.

(56) References Cited

U.S. PATENT DOCUMENTS 1,930,047 A * 10/1933 Halfvarson ..... 200/425
3,527,962 A * 9/1970 Lundgren et al. ..... 327/420
5,430,264 A * 7/1995 Shinohara et al. ..... 200/47
6,815,626 B1 * 11/2004 Hsu ..... 200/315

* cited by examiner

*Primary Examiner*—Elvin G Enad
*Assistant Examiner*—Lheiren Mae A Anglo
(74) *Attorney, Agent, or Firm*—Rosenberg, Klein & Lee

(57) ABSTRACT

A limit switch includes a control member which has a first end protruding from the body of the switch and a second end of the control member has a first contact portion and a second contact portion. A first operation unit and a second operation unit are respectively located on two respective outsides of the first and second contact portions so that the two operation units are activated by shifting the control member. The two operation units are located on two sides of the control member so that the limit switch occupies has lower height.

5 Claims, 9 Drawing Sheets

LIMIT SWITCH WITH TWO OPERATION UNITS CONTROLLED BY A SINGLE CONTROL MEMBER

FIELD OF THE INVENTION

The present invention relates to a limit switch with two operation units located on two sides of a control member such that the switch is flat and occupies less space.

BACKGROUND OF THE INVENTION

A conventional limit switch 6 is shown in FIG. 11 and generally includes a button 61 to control the circuit between "ON" and "OFF" positions. When applied to a machine such as a linear activator which moves in two directions, two limit switches 6 are overlapped as disclosed in FIG. 12 and the two limit switches 6 are controlled by an upper cam 7 and a lower cam 8. The upper and lower cams 7 and 8 are controlled by a shaft 9 cooperated with a gear set 91 so that when the protrusion 71 on the upper cam 7 rotates clockwise to push the button 61 of the upper limit switch 6, the linear activator stops in a first direction, and moves in a second direction. When the protrusion 81 of the lower cam 8 rotates counter clockwise to push the button of the lower limit switch 8, the linear activator stops in the second position and moves toward the first direction.]

However, the overlapped two limit switches 6 make the control unit to have a certain height which may not suitable for some machine. Besides, the two limit switches 6 require more maintenance cost and time.

The present invention intends to provide a limit switch wherein the two operation units are located in the same plane and controlled by a single control member which located between the two operation units so that the height of the whole control unit is reduced.

SUMMARY OF THE INVENTION

The present invention relates to a limit switch which comprises a body with an interior space and a control member is received in the body and has a first end protruding from the body. A second end of the control member has a first contact portion and a second contact portion. An activation assembly is received in the body and includes a first operation unit and a second operation unit. The first and second operation units are located on two respective outsides of the first and second contact portions.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
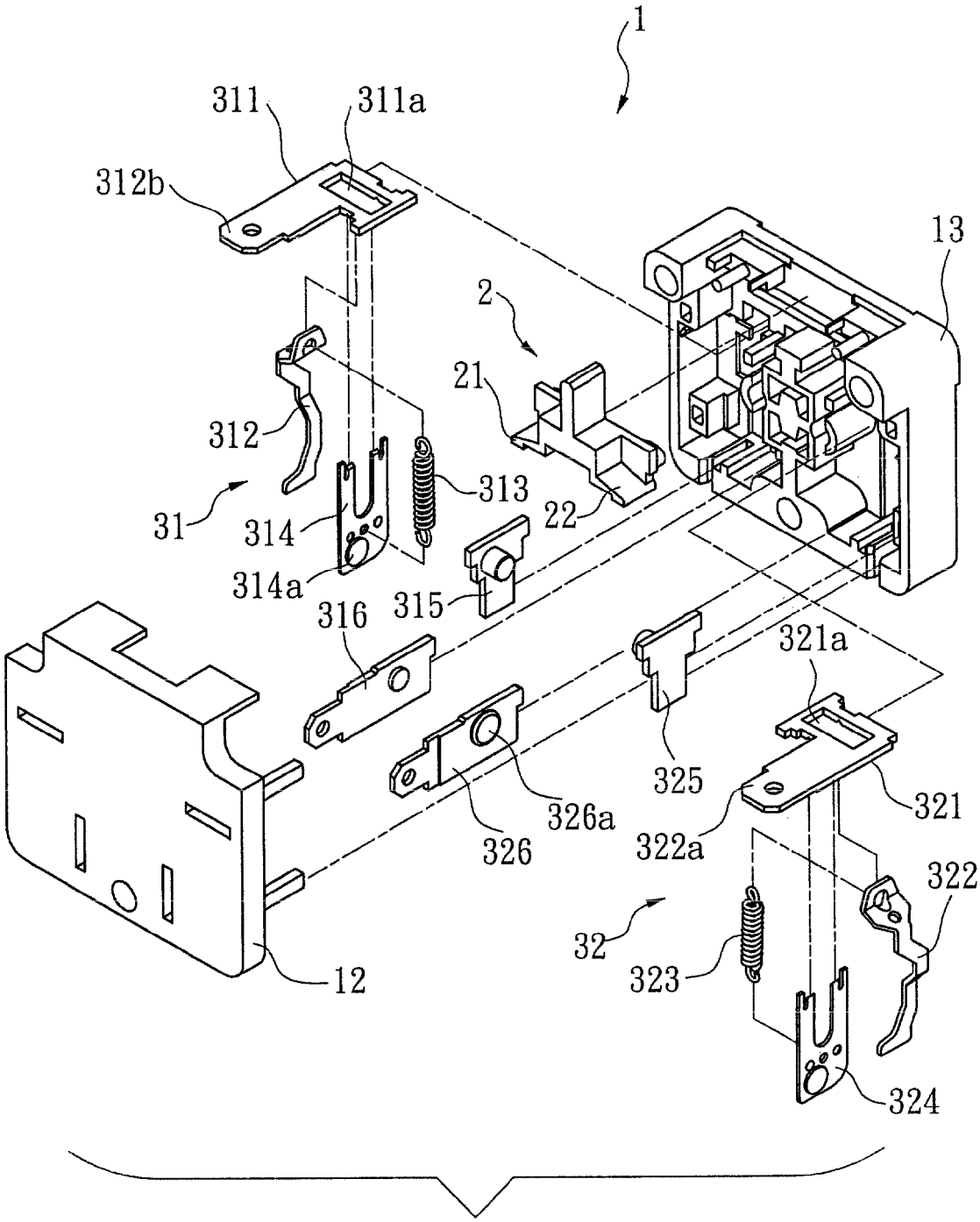
FIG. 1 is an exploded view to show the limit switch of the present invention.
Figure 2:
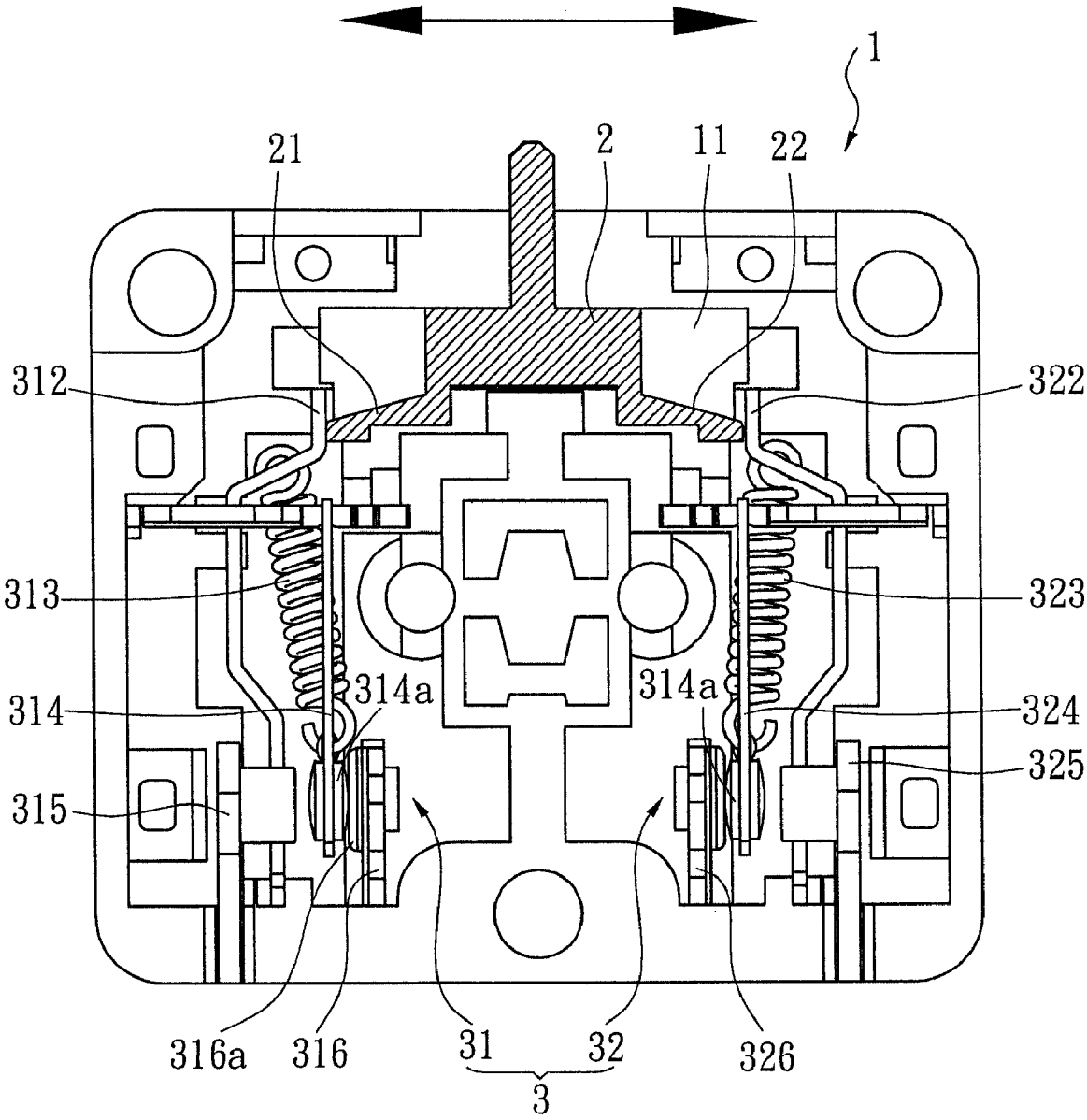
FIG. 2 shows the parts arranged in the body of the limit switch of the present invention.

Referring to FIGS. 1 and 2, the limit switch 1 of the present invention comprises a body 1 composed of a first part 11 and a second part 12, and the body 1 has an interior space 11 defined therein. A control member 2 such as a lever is received in the body 1 and has a first end protruding from the body 1, and a second end of the control member 2 has a first contact portion 21 and a second contact portion 22 respectively extending from two sides thereof.

Figure 3:
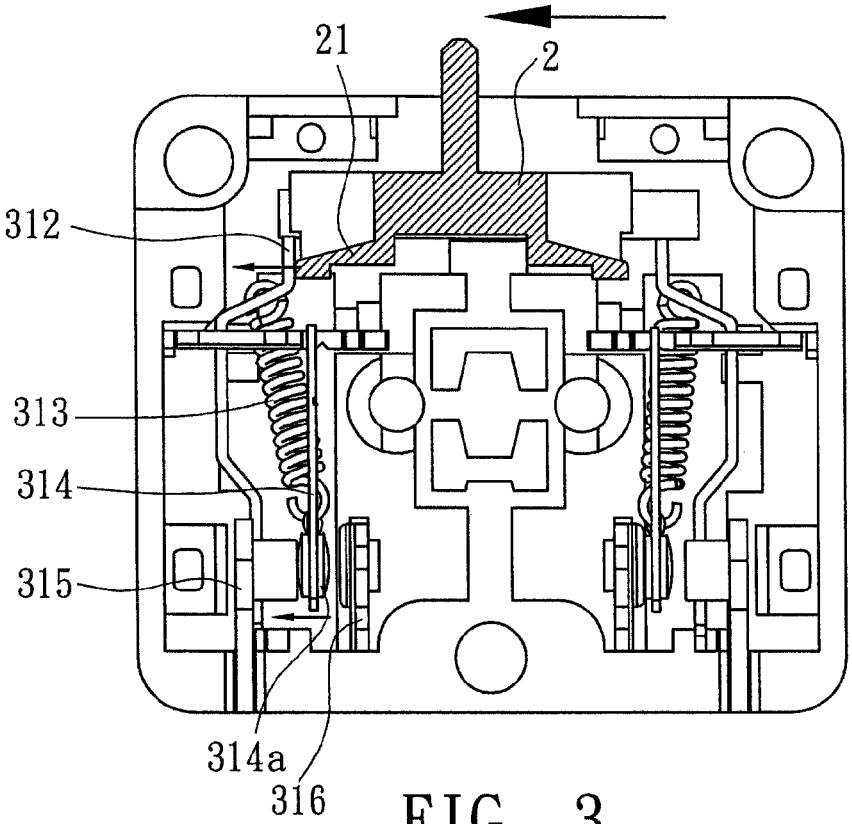
FIG. 3 shows that the control member is shifted to left to activate the first operation unit.
Figure 4:
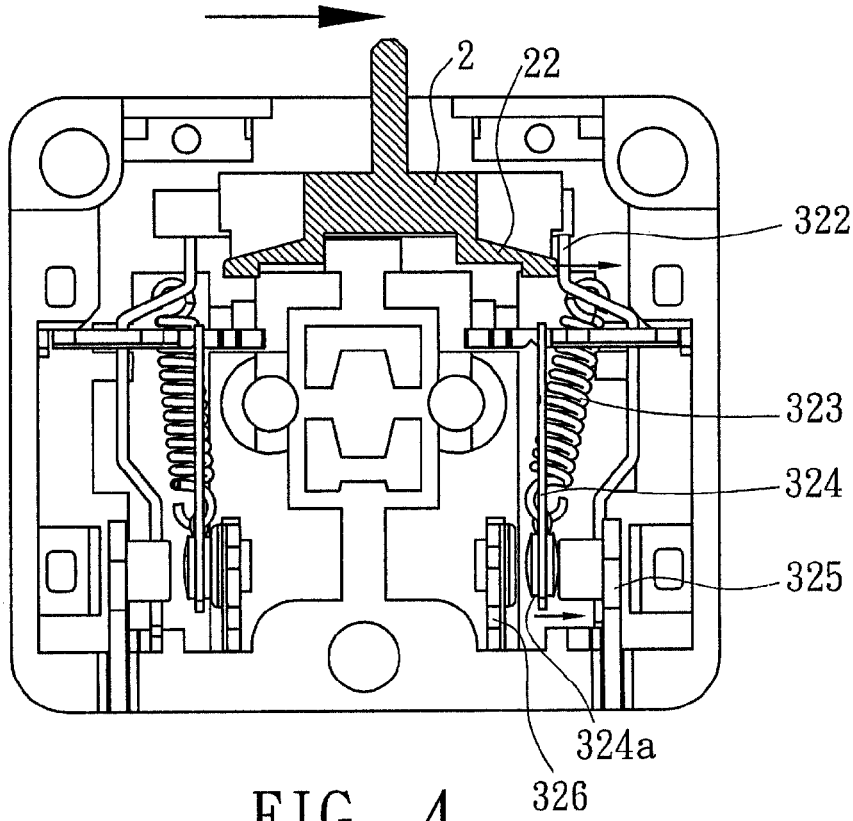
FIG. 4 shows that the control member is shifted to right to activate the second operation unit.

An activation assembly 3 is received in the body 1 and includes a first operation unit 31 and a second operation unit 32. The first and second operation units 31, 32 are located on two respective outsides of the first and second contact portions 21, 22, so that when the control member 2 is shifted to left as shown in FIG. 3, the first operation unit 31 is activated, and when the control member 2 is shifted to right as shown in FIG. 4, the second operation unit 31 is activated.

The first operation unit 31 includes a first plate 311, a support plate 312, a biasing member 313 which is a spring, a swing plate 314 with a contact point 314*a*, a stationary plate 315 and a second plate 316 which has a second contact point 316*a*. The second operation unit 32 has the same structure as the first operation unit 31 and includes a first plate 321, a support plate 322, a biasing member 323 which is a spring, a swing plate 324 with a contact point 324*a*, a stationary plate 325 and a second plate 326 with a second contact point 326*a*. The first operation unit 31 is arranged in a way that is a mirror-image of the second operation unit 32.

The first plate 311 includes a hole 311*a* defined in a first end thereof and a second end 312*b* of the first plate 311 extends out from the body 1. The support plate 312 extends through the hole 311*a* of the first plate 311 and is connected to a hook on an end of the biasing member 313. Another hook on the other end of the biasing member 313 is connected with the swing plate 314. The swing plate 314 is located between the stationary plate 315 and the second plate 316. The contact point 316*a* is located on the first end of the second plate 316, and the second end of the second plate 316 extends out from the body 1. The first plate 311 and the second plate 316 can be connected with a power source which is not shown.

The second plate 321 includes a hole 321*a* defined in a first end thereof and a second end 322*a* of the first plate 321 extends out from the body 1. The support plate 322 extends through the hole 321*a* of the first plate 321 and is connected to a hook on an end of the biasing member 323. Another hook on the other end of the biasing member 323 is connected with the swing plate 324. The swing plate 324 is located between the stationary plate 325 and the second plate 326. The contact point 326*a* is located on the first end of the second plate 326, and the second end of the second plate 326 extends out from the body 1. The first plate 321 and the second plate 321 can be connected with a power source which is not shown.

In a neutral position, the control member 2 is located at a mediate portion of the body 1 as shown in FIG. 2. When the control member 2 is shifted to left, the first contact portion 21 pushes the support plate 312 to left and pulls the biasing member 313 so that the swing plate 314 is pivoted left and the contact point 314*a*on the swing plate 314 is in contact with the stationary plate 315 as shown in F*ig*. 3. When shifting the control member 2 to right, the second contact portion 22 pushes the support plate 322 to right and pulls the biasing member 323 so that the swing plate 324 is pivoted right and the contact point 324*a* on the swing plate 324 is in contact with the stationary plate 325 as shown in FIG. 4.

Figure 5:
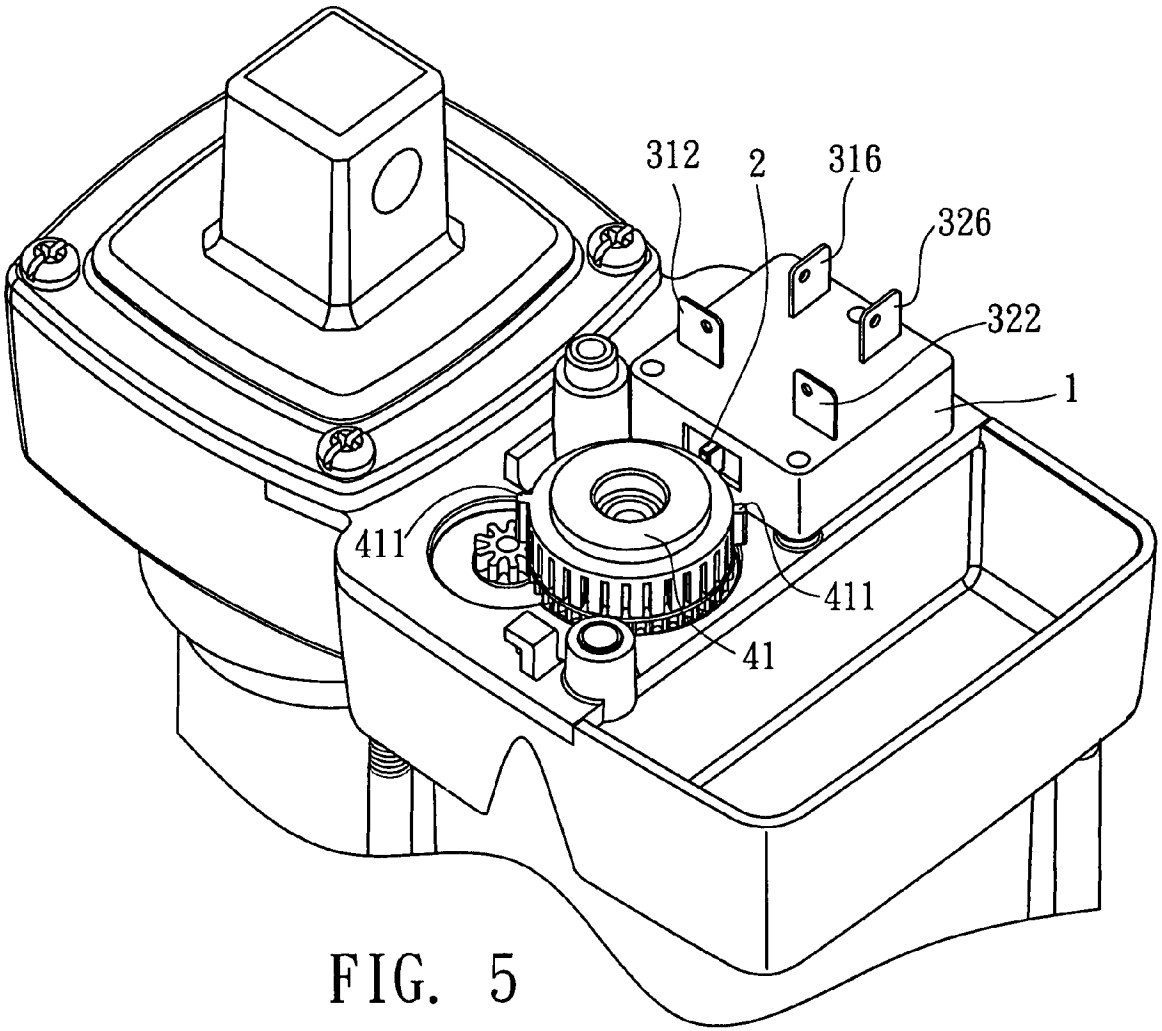
FIG. 5 shows a driving member is cooperated with the limit switch of the present invention.
Figure 6:
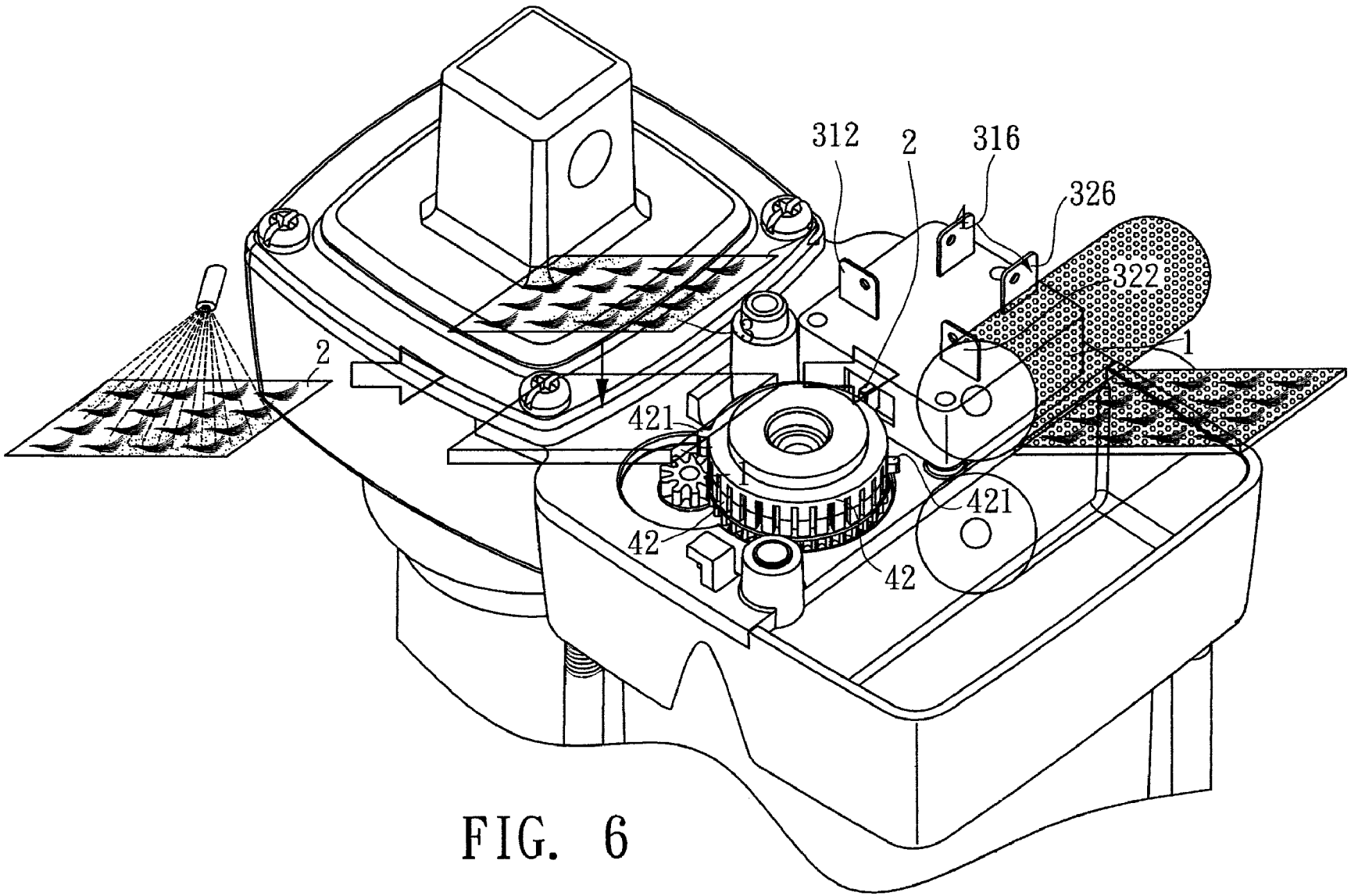
FIG. 6 shows two driving members are cooperated with the limit switch of the present invention.

As shown in FIGS. 5 and 6, a driving member 41 is cooperated with the limit switch 1 of the present invention, wherein the driving member 41 includes two protrusions 411 which are located diametrically on the circular driving member 41. When the driving member 41 rotates, the two protrusions 411 shift the control member 2 alternatively to control the linear activator (not shown) with the limit switch 1. Therefore, because of the arrangement of the operation units 31, 32 and the control member 2, the limit switch 1 is flat and has low profile.

Figure 7:
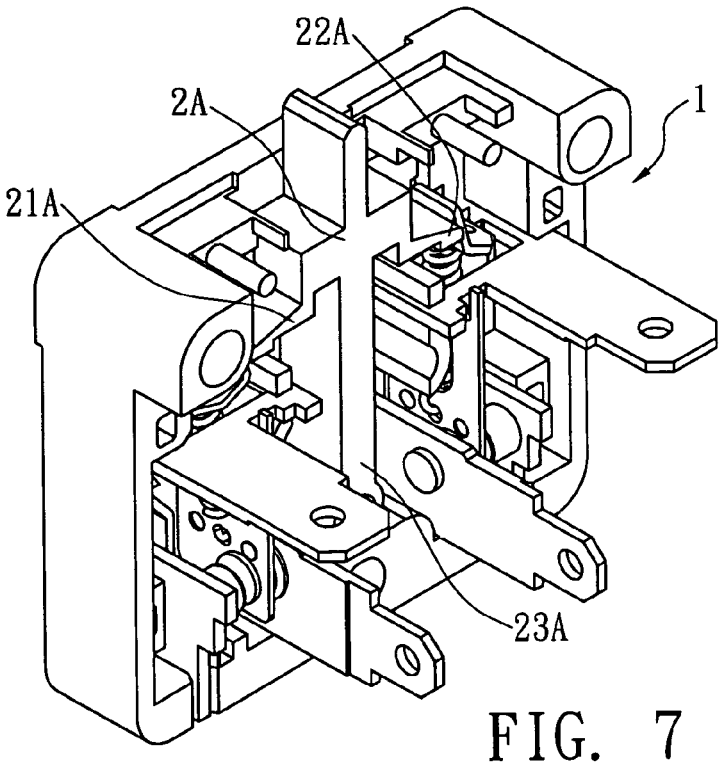
FIG. 7 is a perspective view to show a second embodiment of the limit switch of the present invention.
Figure 8:
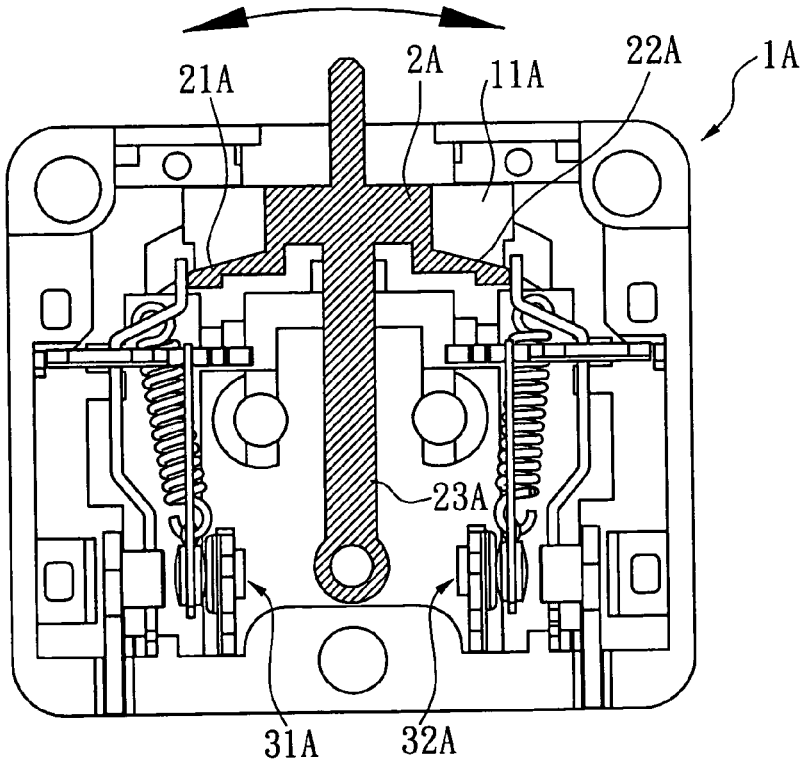
FIG. 8 shows the parts arranged in the body of the limit switch in FIG. 7 of the present invention.

FIGS. 7 and 8 show a second embodiment of the present invention wherein the control member 2A includes a shank 23A which has a first end protruding from the body 1A and a second end of the shank 23A is pivotably connected in the body 1A, so that the control member 2A can be pivotable relative to the body 1A. The first and second contact portions 21A, 22A are connected on two sides of the shank 23A and the first and second operation units 31A, 32A are located corresponding to the first and second contact portions 21A, 22B. Similarly, when pivoting the control member 2A, the support plate is pushed to pivot the swing member to separate the two contact points on the swing plate and the second plate.

Figure 9:
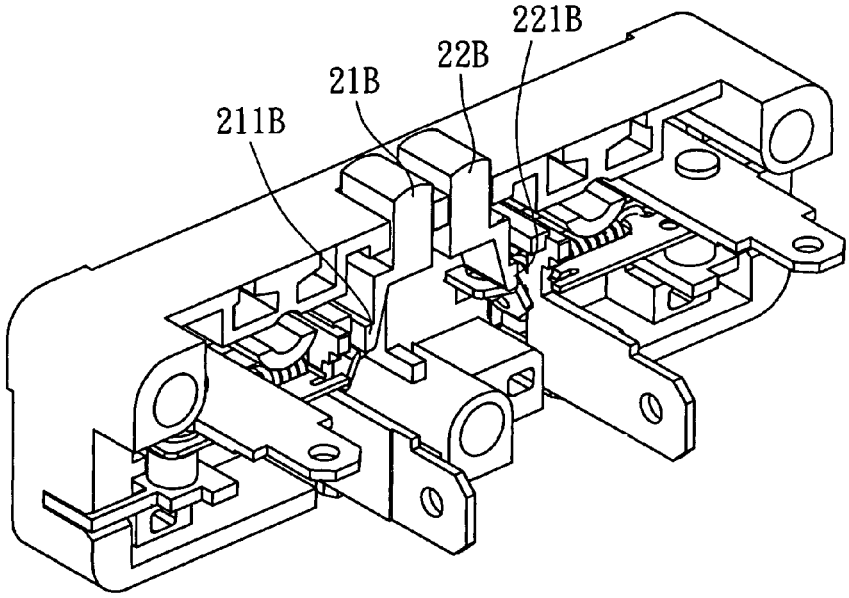
FIG. 9 is a perspective view to show a third embodiment of the limit switch of the present invention.
Figure 10:
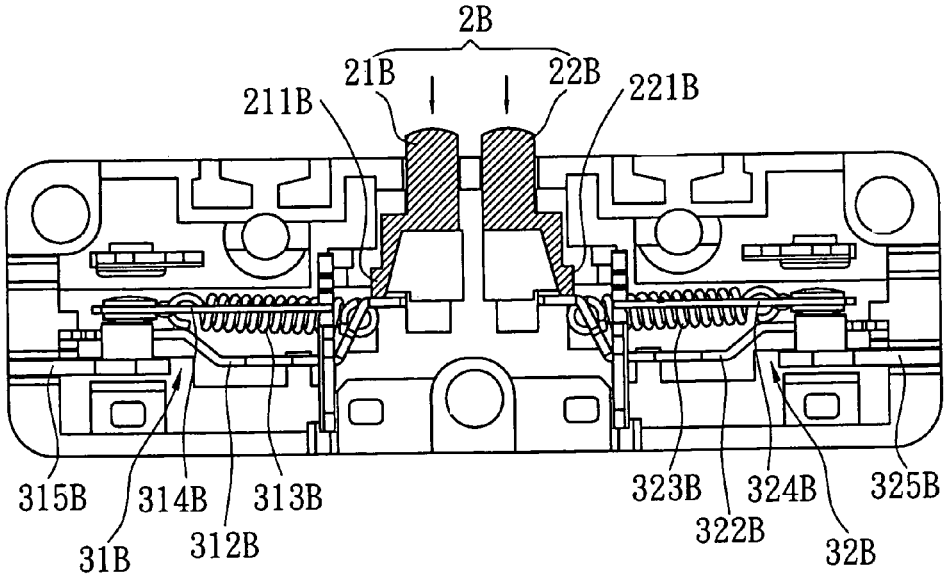
FIG. 10 shows the parts arranged in the body of the limit switch in FIG. 9 of the present invention.
Figure 11:
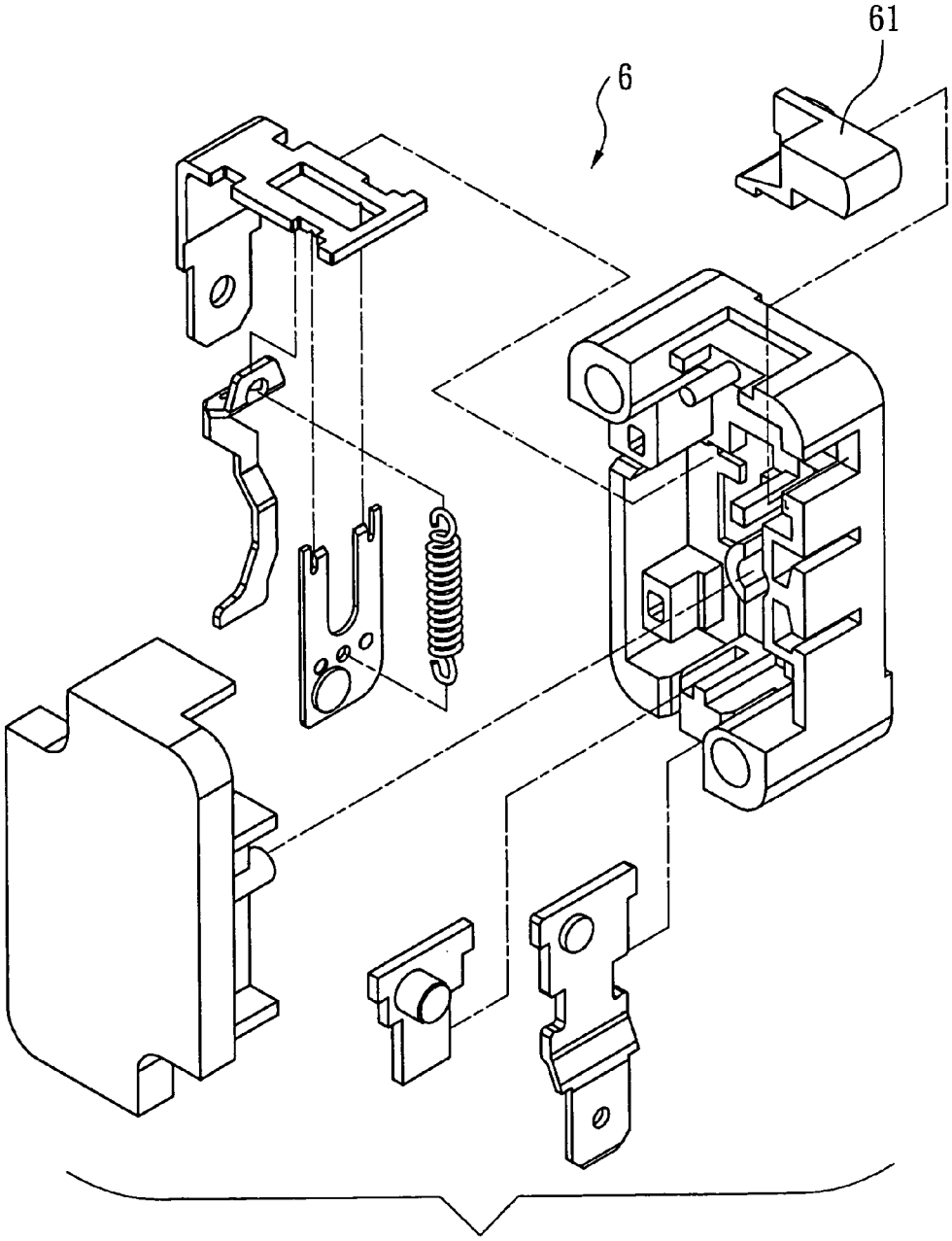
FIG. 11 PRIOR ART
FIG. 11 is an exploded view to show a conventional limit switch.
Figure 12:
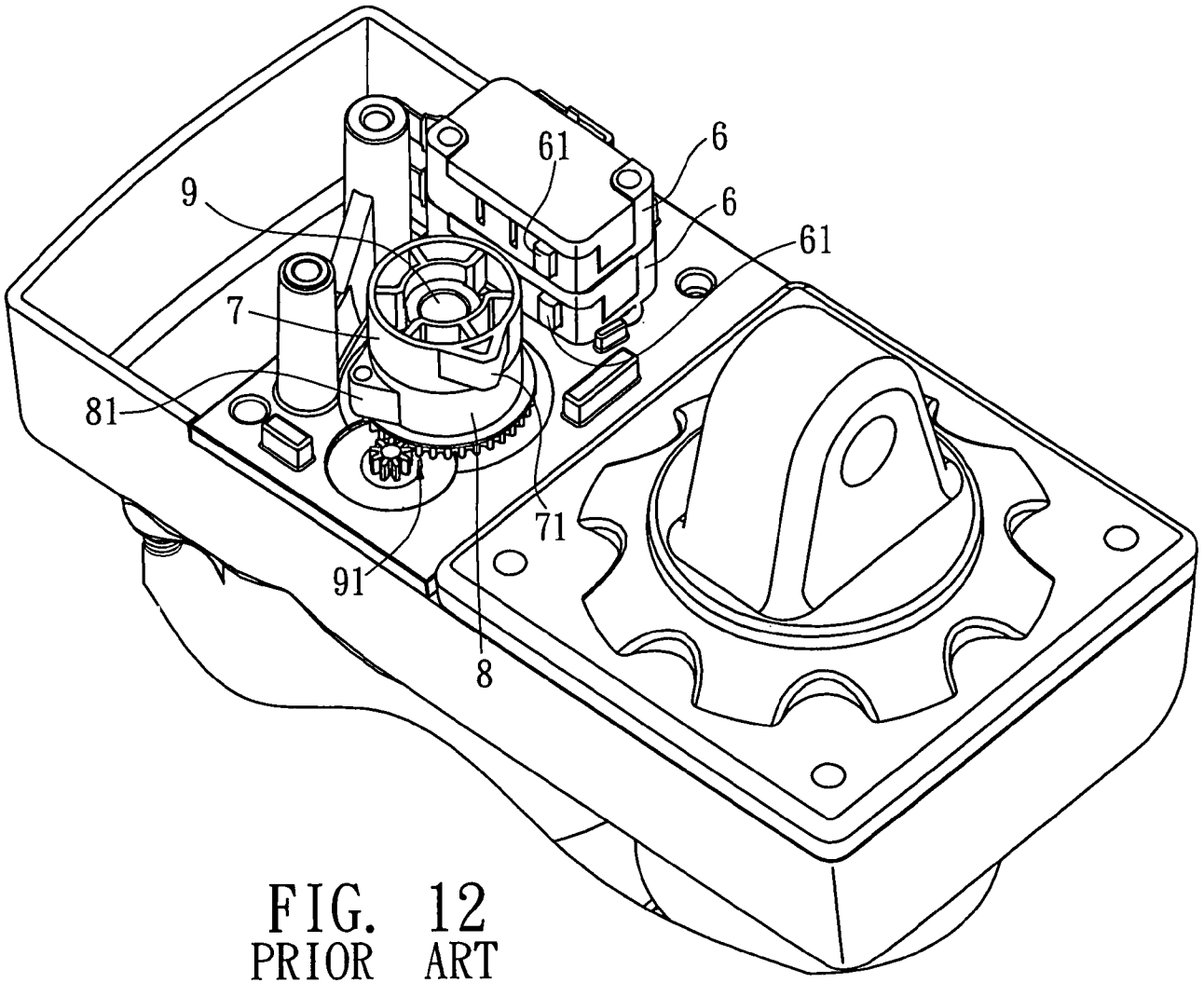
FIG. 12 PRIOR ART
FIG. 12 shows two cams are cooperated with the conventional limit switch shown in FIG. 11.

FIGS. 9 and 10 show a third embodiment of the present invention wherein the control member 2B includes a first button 21B and a second button 22B which are extended out from the body. Each of the first button 21B and the second button 22B has a contact portion 211B/221B, and the first and second operation units 31B, 32B are located at two respective outsides of the first and second contact portions 211B, 221B. The first operation unit 31B includes a first plate, a support plate 312B, a biasing member 313B, a swing plate 314B with a contact point, a stationary plate 315B and a second plate with another contact point. The second operation unit 32B includes a first plate, a support plate 322B, a biasing member 323B, a swing plate 324B with a contact point, a stationary plate 325B and a second plate with another contact point. The two respective contact portions on the first and second buttons 21B, 22B are alternative pushed to activate the first and second operation units 31B, 32B which are located horizontally to achieve the same functions and purposes as the previous embodiments.

When the first button 21B is pushed, the first contact portion 211B pushes the support plate 312B downward and pulls the biasing member 313B so that the swing plate 314B is pivoted and the contact point on the swing plate 314 is in contact with the stationary plate 315B. When the second button 22B is pushed, the second contact portion 221B pushes the support plate 322B downward and pulls the biasing member 323B so that the swing plate 324B is pivoted and the contact point on the swing plate 324B is in contact with the stationary plate 325B.

While we have shown and described the embodiment in accordance with the present invention, it should be clear to those skilled in the art that further embodiments may be made without departing from the scope of the present invention.

What is claimed is:

1. A limit switch comprising: a body composed of a first part and a second part, an interior space defined in the body; a control member received in the body and having a first end protruding from the body, a second end of the control member having a first contact portion and a second contact portion, and an activation assembly received in the body and including a first operation unit and a second operation unit, the first and second operation units located on two respective outsides of the first and second contact portions wherein the first operation unit includes a first plate, a first support plate, a first biasing member, a first swing plate with a contact point, a first stationary plate and a second plate; and wherein the second operation unit includes a first plate, a second support plate, a second biasing member, a second swing plate with a contact point, a second stationary plate and a second plate.

2. The limit switch as claimed in claim 1, wherein the control member is a lever.

3. The limit switch as claimed in claim 1, wherein the first and second operation units are located corresponding to the first and second contact portions respectively.

4. The limit switch as claimed in claim 1, wherein the control member includes a shank which has a first end protruding from the body and a second end of the shank is pivotably connected in the body, the first and second contact portions are connected on two sides of the shank and the first and second operation units are located corresponding to the first and second contact portions.

5. The limit switch as claimed in claim 1, wherein the control member includes a first button and a second button, each of the first button and the second button has a contact portion, the first and second operation units are located at two respective outsides of the first and second contact portions.

* * * * *